United States Patent [19]

Kafarowski

[11] Patent Number: 4,768,322

[45] Date of Patent: Sep. 6, 1988

[54] STONE SLAB MOUNTING

[75] Inventor: Z. Grant Kafarowski, Richmond Hill, Canada

[73] Assignee: Artex Precast Limited, Toronto, Canada

[21] Appl. No.: 128,468

[22] Filed: Dec. 3, 1987

Related U.S. Application Data

[63] Continuation-in-part of Ser. No. 13,546, Feb. 11, 1987.

[51] Int. Cl.[4] ..... E04B 2/88

[52] U.S. Cl. ..... 52/235; 52/511; 52/508; 403/379; 411/446

[58] Field of Search ..... 52/511, 506, 235, 508; 411/446; 403/263, 378, 379

[56] References Cited

U.S. PATENT DOCUMENTS 2,135,322 11/1938 Brantingson ..... 403/379
3,613,221 10/1971 Pronk ..... 403/379
4,226,068 10/1980 Wadsworth ..... 52/511
4,701,065 10/1987 Orosa ..... 403/263
4,711,603 12/1987 Rippe ..... 403/379

FOREIGN PATENT DOCUMENTS 2740131 3/1979 Fed. Rep. of Germany ..... 52/511

*Primary Examiner*—Henry E. Raduazo
*Attorney, Agent, or Firm*—Riches, McKenzie & Herbert

[57] ABSTRACT

A mechanical mounting is disclosed to mount thin stone slabs as the facade of buildings in which a bolt hole and a pin hole are drilled into the rear surface of the slab to intersect and with the pin hole to pass through the bolt hole and end in the slab therepast. A pin in the pin hole extends through a first bolt in the bolt hole with the pin coupled to the first bolt and extending in the pin hole into the slab on either side of the bolt hole. The pin extends rearwardly out of the slab to be coupled to a second bolt. The first and second bolt members are coupled to a support frame and form with the pin a rigid truss to assist in bearing the weight of the slab without deformation of the first bolt.

18 Claims, 7 Drawing Sheets

STONE SLAB MOUNTING

This application is a continuation in part of U.S. patent application Ser. No. 013,546, filed Feb. 11, 1987.

SCOPE OF THE INVENTION

This invention relates to the mounting of stone slabs to structures, and more particularly to the supporting of thin sheets of granite, marble or other masonry to form an exterior facade.

BACKGROUND OF THE INVENTION

In the past stone slabs forming an exterior facade of buildings have been secured to the building structure utilizing adhesives. However, some building codes now require stone slabs be mechanically coupled to structures. Previously known mechanical systems to mount stone slabs have not been satisfactory.

For example, U.S. Pat. No. 4,060,951 to Gere teaches a mechanical mounting system in which a plug hole is drilled into the edge of a slab to intersect at right angles with a bolt hole drilled into the rear of the slab. A bolt in the bolt hole is threaded into a plug in the plug hole. With the bolt secured to the structure, the bolt and plug cooperate to mechanically mount the slab to the structure. In Gere location of the plug hole on the edge of the slab is disadvantageous as difficult to access to drill the hole and, particularly in an assembled facade, to access the hole as may be necessary to change a slab. Moreover, the location of the plug hole and bolt hole near an edge is disadvantageous as being a location where the slab may most readily fracture thus substantially reducing the forces which the mechanical mounting may withstand, as determined by the nature of the stone slab being used and particularly its thickness.

U.S. Pat. No. 3,786,605 to Winfrey teaches a mechanical system for mounting slabs by slots cut into the top and bottom ends of the slabs into which pins may vertically extend supported on metal supports extending horizontally from the structure. In Winfrey location of the slots along the edges of the block reduces the ultimate strength of the system.

U.S. Pat. No. 4,531,338 to Donalt provides two studs which extend at an angle with respect to each other, diverging away from each other, into a slab with the rear ends of the studs crossing rearward of the slab. By encasing the crossing rear ends in enclosed pockets filled with epoxy, the rear ends of the studs effectively form a closed loop secured to the structure. Donalt has the disadvantage of being complex to assemble and relying on the epoxy bonding to maintain the joint. Further Donalt limits its structure to being a poured concrete slab. Donalt is not practical on steel structures.

SUMMARY OF THE INVENTION

Accordingly, it is an object of the present invention to at least partially overcome the disadvantages of the prior art by providing a slab mounting with a bolt hole and a pin hole both extending from the rear surface into the slab to intersect with the pin hole to pass through the bolt hole and end in the slab therepast, wherein a pin in the pin hole extends through a bolt in the bolt hole with the pin coupled to the bolt and extending in the pin hole into the slab on either side of the bolt hole.

Another object is to provide a mechanical mounting which increases the maximum forces which may be withstood thereby and which permits safe use of thinner slabs of stone, concrete and similar materials.

Another object is to provide a mechanical mounting for a facing slab which forms an integral truss and can readily be coupled to and adjusted relative to the support structure.

Another object is to provide a method of assembly of a pre-fabricated wall panel.

In one of its aspects the present invention provides a wall assembly wherein a facing slab is mounted to a support structure, the slab having a rear surface, the improvement comprising:

a first bore extending into the slab from the rear surface and ending at a first blind end, a second bore extending into the slab from the rear surface to intersect the first bore, through the first bore, and into the slab beyond the first bore where the second bore ends at a second blind end, first elongate bolt means having a front portion in the first bore and a rear portion which extends rearwardly from the rear surface of the slab, a threaded first aperture through the first bolt means coaxially aligned with the second bore, threaded elongate pin means having a front portion in the second bore and a rear portion which extends rearwardly from the rear surface of the slab, the front portion of the pin means disposed in the second bore in threaded engagement within the first aperture of the first bolt means and passing through the first bore at least partially into that segment of the second bore in the slab beyond the first bore, second elongate bolt means having a front portion and a rear portion with the rear portion carrying first means for coupling to the support structure, the rear portion of one of the pin means and the first bolt means coupled to the front portion of the second bolt means, the rear portion of the other of the pin means and the first bolt means carrying second means for coupling to the support structure, the rear portion of the second bolt means being disposed parallel to the rear portion of the other of the pin means and the first bolt means, the first and second means for coupling to the support structure providing for movement of the second bolt means and the one of the pin means and first bolt means in a direction parallel to that in which the rear portion of the second bolt means is disposed and providing for adjustable locking at different positions, and wherein upon locking the first and second coupling means the first and second bolt means and the pin means form with the support structure a rigid truss to support and anchor the slab.

BRIEF DESCRIPTION OF THE DRAWINGS

Further aspects and advantages will appear from the following description taken together with the accompanying drawings in which.

DESCRIPTION OF PREFERRED EMBODIMENTS

Figure 1:
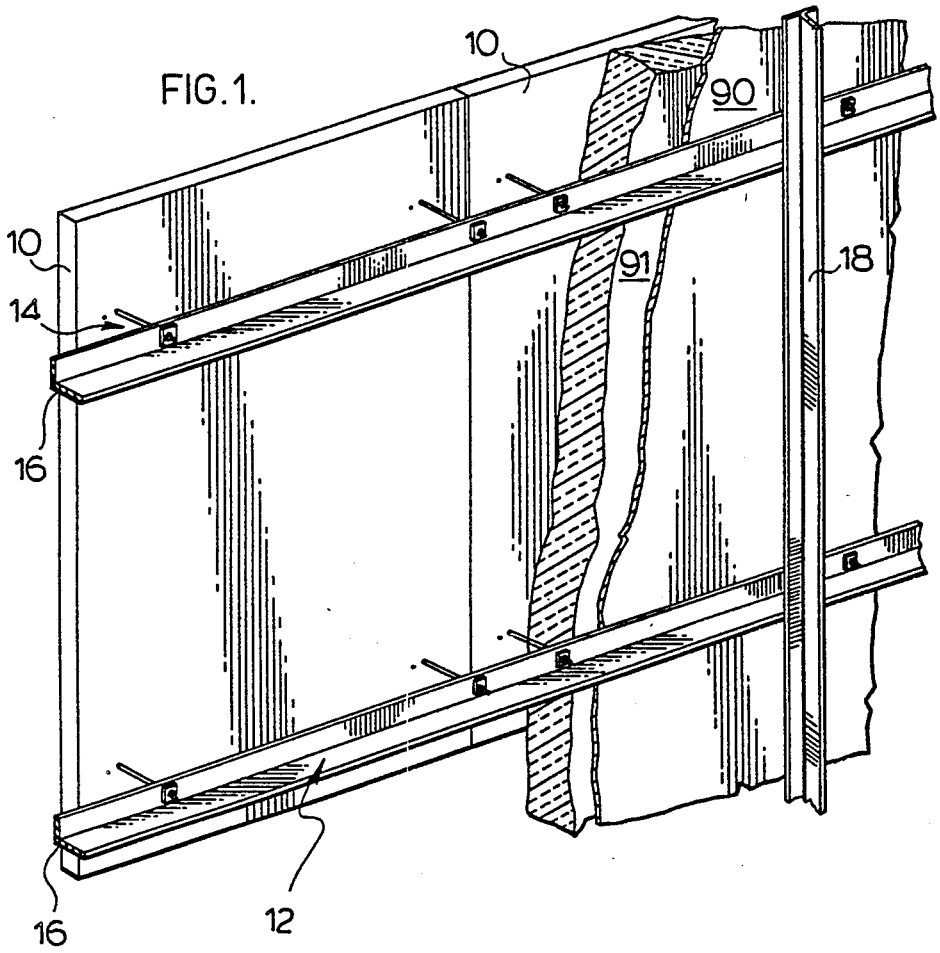
FIG. 1 is a pictorial view of a stone slab mounted to a metal frame of a modular wall panel in accordance with the present invention.

Reference is made first to FIG. 1 which shows a slab 10 of stone securely coupled to a metal framework 12 at four locations by mountings of the present invention generally indicated as 14. Frame 12 comprises horizontal angle beams 16 and vertical angle beams 18. These beams are illustrative only and may comprise portions of a metal frame for a modular wall panel to be pre-fabricated to include a plurality of stone slabs. A complete wall panel may be transported to a building site and coupled to a building as a unit.

Frequently used stone slabs have a thickness of about 1 to 2 inches and varying width and length, frequently about 5 to 6 feet in width and 5 to 6 feet in length.

Figure 2:
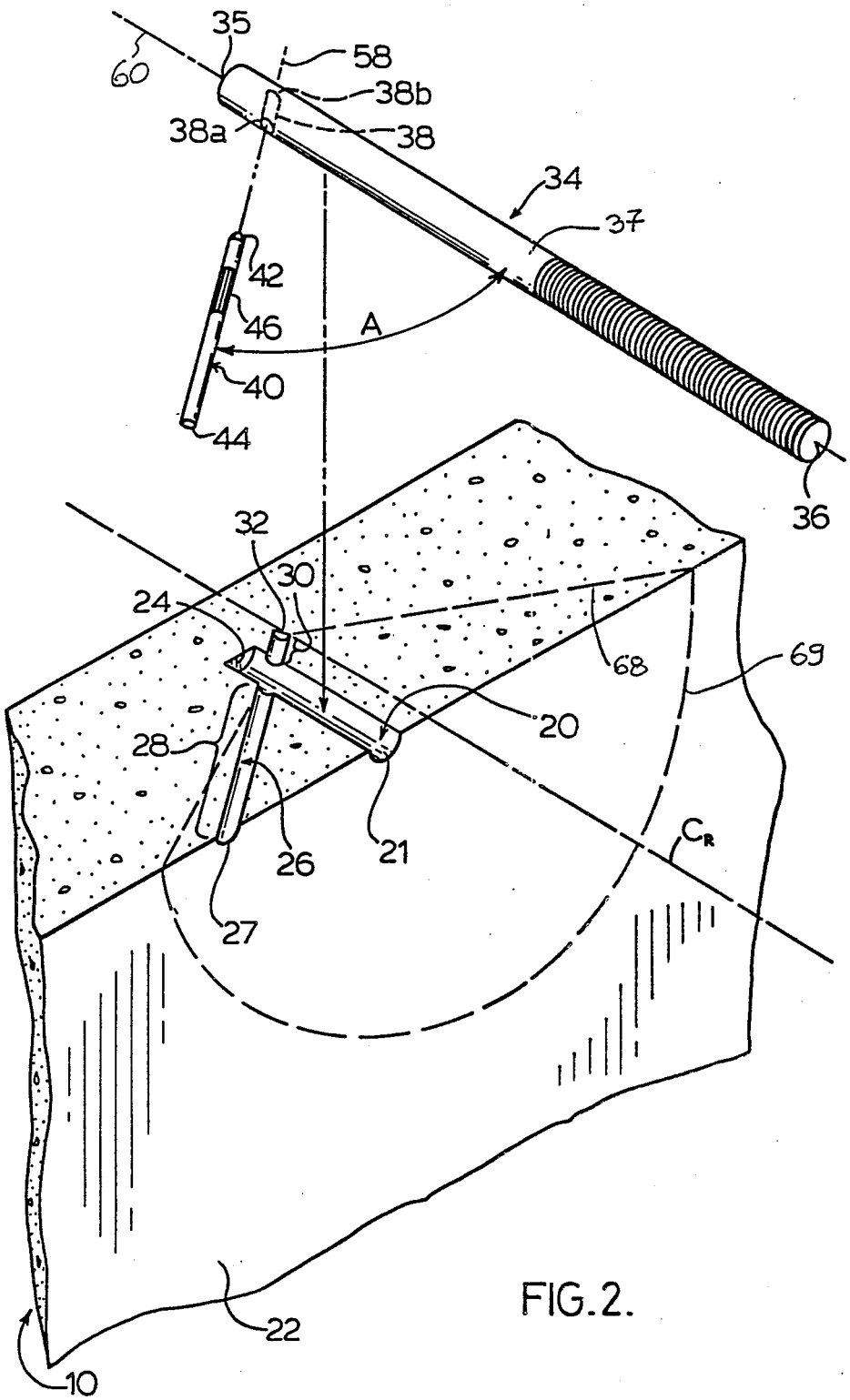
FIG. 2 is an exploded view of a first embodiment of a bolt member and a complementary pin member shown over a cross-sectional top view of a segment of the slab of FIG. 1 showing a bolt hole and pin hole therein.

FIG. 2 best shows the two holes drilled into the rear of slab 10. Slab 10 has a bolt hole 20 drilled to extend into the slab from rear surface 22 approximately perpendicular to rear surface 22. Bolt hole 20 extends from a rear entrance 21 on rear surface 22 forward to a first blind end 24.

Slab 10 also has a pin hole 26 drilled to extend into slab 10 from rear surface 22 and angled to intersect bolt hole 20. Pin hole 26 commences at a rear entrance 27 on rear surface 22 which is spaced to one, first side from the rear entrance 21 of bolt hole 20. The pin hole 26 extends forwardly from its rear entrance 27 at an acute angle to the bolt hole so as to pass, as a first segment 28, through the slab to the bolt hole, through the bolt hole and then to extend, as a second segment 30, into the slab on the other, second side of the bolt hole ending at second blind end 32.

A first embodiment of a bolt member 34 and complementary pin member 40 is shown in FIG. 2, in an orientation generally as adapted to be received in the holes 20 and 26 in slab 10 therebelow.

Bolt member 34 has a front end 35, a rear end 36 and a generally cylindrical side surface 37 which is threaded near its rear end for coupling to angle beam 16. An aperture 38 extends through bolt member 34 from aperture entrance opening 38*a* to aperature exit opening 38*b*.

Pin member 40 is also generally cylindrical and has a forward end 42 and a rear end 44.

Figure 4:
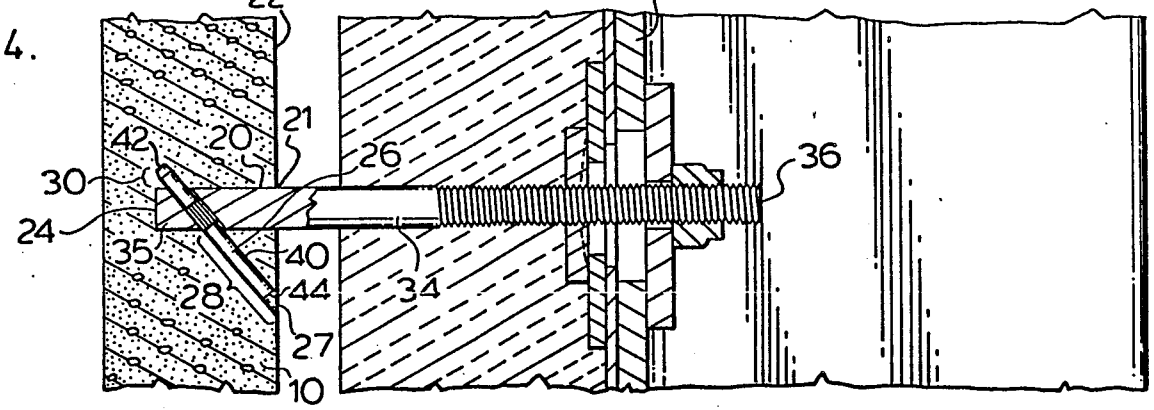
Figure 6:
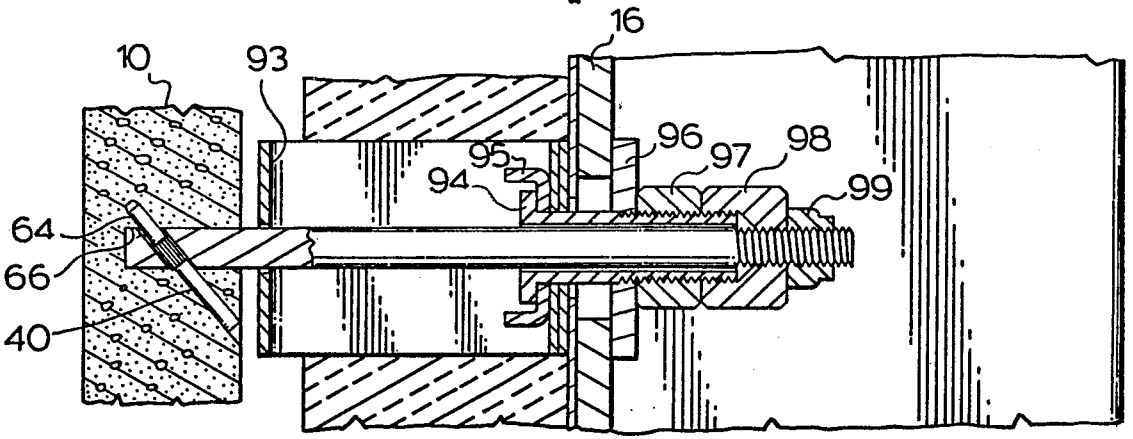

As seen in FIGS. 4 or 6 bolt member 34 is to be located in bolt hole 20 with its front end 35 near first blind end 24 and the bolt to extend rearwardly out the bolt hole to its rear end 36. Bolt member 34 can be coupled near its rear end to angle beam 16.

Aperture 38 is located in bolt member 34 so that with bolt member 34 located within bolt hole 20, aperture 38 can be coaxially aligned with segments 28 and 30 of pin hole 26.

Pin member 40 is to be located in pin hole 26 extending via aperture 38 through bolt member 34 so that pin member 40 lies in both the segments 28 and 30 of pin hole 26 with the forward end 42 of pin member 40 near second blind end 32 of pin hole 26 and the rear end 44 of pin member 40 near rear entrance 27 of pin hole 26.

Pin member 40 frictionally engages bolt member 34 inside of aperture 38. As best seen in FIG. 2, pin member 40 preferably carries raised longitudinally extending serrations 46 sized to be received in force fit relation in aperture 38 to resist removal of pin member 40 therefrom. With pin member 40 inserted into aperture 38, bolt member 34 can not be removed from bolt hole 20 and bolt member 34 is thus mechanically coupled to slab 10.

Figure 9:
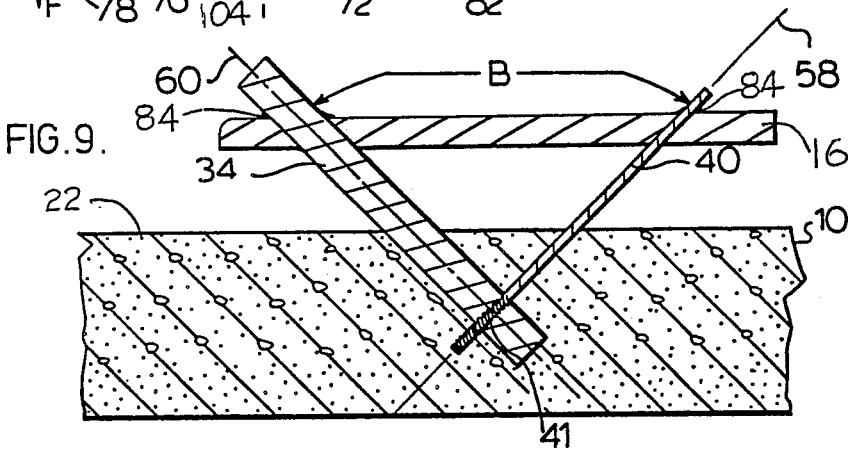
FIG. 9 shows a cross-sectional side view of another embodiment of a mounting in accordance with the present invention.

FIG. 2 shows a first embodiment of a bolt member 34 and a complementary serrated pin member 40 which are also illustrated in FIGS. 3 to 6. FIG. 9 shows a second, preferred embodiment of bolt member 34 and a complementary threaded pin member 40 carrying external threads 41 adapted to engage internal threads provided inside aperture 38. In FIG. 9, identical reference number are used to show elements similar to those in the embodiment of FIG. 2. In the embodiment of FIG. 9, with pin member 40 threaded into aperture 38, bolt member 34 can be secured against removal from a slab 10.

Bolt hole 20, pin hole 26 and aperture 38 are cylindrical bores with bolt member 34 and pin member 40 being cylindrical rods of complementary size. Bolt hole 20 preferably is sized to relatively closely, slidably receive bolt member 34 coaxially therein with the bolt hole 20 marginally greater than the bolt member. Similarly, pin hole 26 is complementarily sized to closely, slidably receive pin member 40 coaxially therein. Preferably, with pin member 40 received in aperture 38 of bolt member 34, axis 58 of pin member 40 intersects with axis 60 of bolt member 34. Preferably in the first embodiment of FIGS. 1 to 6 where the bolt member 34 extends rearward from slab 10 approximately normal to rear surface 22, axis 58 of the pin member 40 and axis 60 of the bolt member 34 intersect to form an acute angle A therebetween (as seen in FIG. 2) rearward of the intersecticn of the axes. Preferably this angle may be in the range of 30′ to 60′, more preferably 35′ to 50′. FIG. 2 shows an angle of about 45′.

While not clearly shown in the drawings when bolt member 34 and pin member 40 are received in slab 10, voids in bolt hole 20 and pin hole 26 not occupied by the bolt member or pin member are preferably filled with an adhesive water-impermeable filler such as known epoxy compounds. Preferably, the rear entrances 21 and 27, respectively, to bolt hole 20 and pin hole 26 will be sealed against moisture penetration to keep water from entering the bolt hole or pin hole.

Bolt member 34 preferably has a squared-off, forward end 35 so that its cylindrical side wall 37 terminates abruptly at forward end 35 as a radially disposed end surface. Aperture exit opening 38*b* preferably is located on the bolt member 34 close to forward end 35 but entirel within the cylindrical side surface 37 of bolt member 34. This is advantageous in that rearward forces attempting to draw the bolt rearwardly from the slab will substantially be resisted by a forwardmost section 64 of pin member 40 best shown in FIG. 6 which extends through bolt member 34 and is received in the second segment 30 of pin hole 26. The rearward forces will attempt to bend this forwardmost section 64 towards the front to withdraw bolt member 34. With at least a small segment 66 of the cylindrical side wall 37 of bolt member 34 being provided forward of aperture exit opening 38*c* bolt member 34 assists in supporting pin member 40 to resist bending. Lesser support would be provided to pin member 40 if, for example, aperture exit opening 38*c* were in the end surface of bolt member 34. It is advantageous that aperture exit opening 38*c* be close to the forward end 35 so that forwardmost section 64 of pin member 40 may not have an excessive length, having regard to the distance which the second blind end 32 may be desired to be located perpendicularly from rear surface 22.

Figure 7:
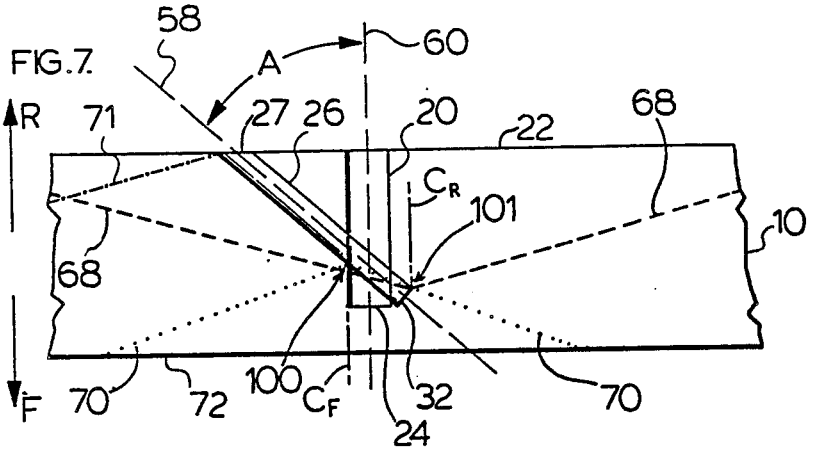
FIG. 7 shows a schematic cross-sectional side view through a slab drilled to accept the mounting of the present invention.

Mountings of the present invention advantageously resist failure of the slab arising as a result of either rearward directed forces acting on the bolt member and attempting to pull the bolt member rearward out of the slab in a direction indicated by arrow R in FIG. 7 or forward directed forces acting on the bolt member and attempting to push the bolt member forward through the slab as indicated by arrow F. When stone slabs such as marble fail as a result of such forces, failure typically occurs along a conical line of fracture, with the angle of the cone being a characteristic of the stone. The surface area of the fracture typically represents the failure strength of the mounting and such surface area increases with increases in the depth of the apex of the cone from a surface towards which the forces are acting. The surface area of the fracture will be decreased where the axis of the cone is located near edge surfaces of a slab.

FIG. 7 illustrates the bolt hole and pin hole in a mounting in accordance with the present invention. Broken lines 68 represents a typical fracture line in the event the slab carrying a mounting of this invention may fail under a rearwardly directed force R acting on a bolt member. Rearward fracture line 68 generally extends from an apex 101 near second blind end 32 rearwardly to rear surfaces 22 at an angle typical of the angle of fracture for a stone slab.

FIG. 2 also schematically shows the same rearward fracture line 68 as shown in FIG. 7. It is to be appreciated that a cone of material will become disengaged from the slab on rearward withdrawl of bolt member 34. This cone is roughly defined by rotating rearward fracture line 68 about rearward cone axis, $C_R$, shown in FIGS. 2 and 7. In FIG. 2, the intersection of the rearward fracture line 68 with rea surface 22 is shown as dotted line 69. FIG. 2 shows the rearward cone axis, $C_R$, as passing through apex 101 and perpendicular to rear surface 22.

Dotted lines 70 in FIG. 7 represent a typical fracture line for failure under a forwardly directed force F. Forward fracture line 70 extends forwardly from an apex 100 forward of the intersection of the pin hole and bolt hole. A cone of material to be detached in such forward failure is roughly defined by rotating forward failure line 70 about forward cone axis, $C_F$. Forward cone axis $C_F$, is shown passing through apex 100 normal to rear surface 22.

If a substantial diameter pin member is used, a sector of the fracture surface may originate as a partial cone from a second apex at rear entrance 27 as shown by dotted and broken line 71. With fracture line 71 extending substantially the entire width of the slab, it may to some extent increase the resistance to forward fracture.

Pin hole 26 may extend a substantial distance through the slab toward the front surface 72 of slab 10 shown in FIG. 7, to increase the resistance to rearward forces, R. Pin hole 26 could extend entirely through the slab although this is not preferred due to moisture sealing problems and consideration regarding visual appearance of front surface 72.

FIGS. 3 to 6 illustrate slab 10 as a $1\frac{1}{4}$ inch thick granite slab in which first blind end 24 is located about 7/8 inch from rear surface 22, that is, with bolt hole 20 extending about 70% of the thickness of the slab. The second blind end 32 of pin hole 26 preferably is located at least as far from rear surface 22, measured perpendicular thereto, as the first blind end 24, more preferably farther from rear surface 22. Second blind end 32 can readily be located at least 50% of the thickness of the slab from rear surface 22 and more preferably at least $\frac{2}{3}$ of the thickness.

Figure 8:
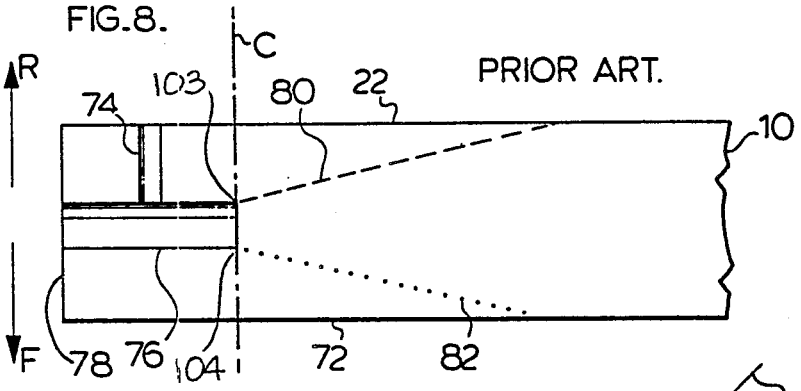
FIG. 8 shows a schematic cross-sectional side view through a prior art slab drilled to accept a mounting of U.S. patent to Gere.

FIG. 8 shows the prior art mounting of U.S. Pat. No. 4,060,951 to Gere showing a plug hole 74 drilled into a slab 10 from a rear surface 22 and a bolt hole 76 drilled into the slab from an edge surface 78. A rearward fracture line 80 and a forward fracture line 82 are shown. The cone axis for both forward and rearward fracture is expected to be the same and is shown as axis C on FIG. 8, normal to rear surface 22. The apex of rearward fracture 103 and the apex of forward fracture 104 are each located less than one half the thickness of the slab from the surface to which the respective fracture extends. Locating the plug hole 74 closer to the front or rear surface of the slab will decrease one of fracture lines 80 and 82. With the apex of both fracture lines close to the edge surface 78 of the slab, the surface area of the cone of fracture is substantially reducted.

FIG. 1 shows slab 10 coupled to framework 12 by four mountings 14. The lower most mountings are shown in FIGS. 3 and 4 while a preferred configuration for the uppermost mountings is shown in FIGS. 5 and 6.

Figure 3:
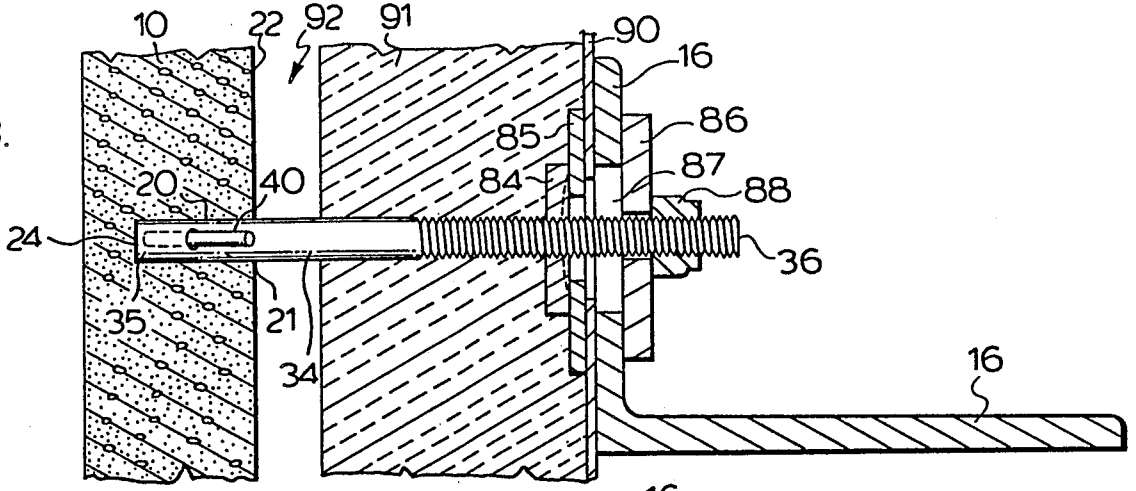
FIGS. 3 and 4 are cross-sectional side and top views, respectively, of a first embodiment of a mounting of this invention utilizing the bolt member and pin member shown in FIG. 2.

Referring to FIGS. 3 and 4, bolt member 34 is threaded near its rear end 36. Bolt member 34 passes through enlarged bore 87 in angle beam 16 and is securely locked thereon by threaded nuts 84 and 88 and washers 85 and 86. The particular prefabricated panel illustrated has a water impermeable inner layer of sheet metal 90, an insulation layer 91, an air space 92 and an outer layer of slabs 10. With slabs 10 thus hung spaced horizontally from angle member 16, it is preferred to provide mechanical reinforcement to assist bolts 34 in carrying the vertical loading.

Figure 5:
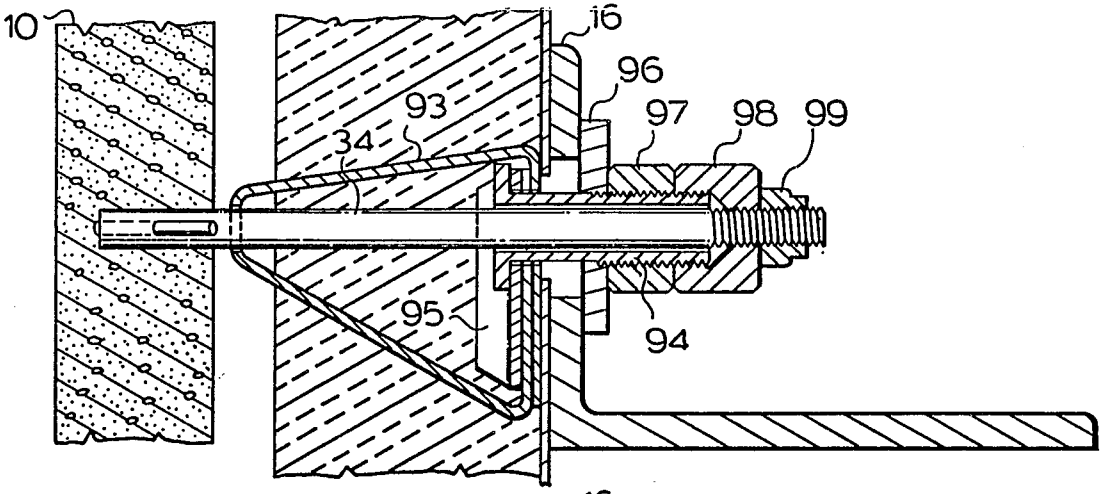
FIGS. 5 and 6 are cross-sectional side and top views, respectively, of a mounting similar to that in FIGS. 3 and 4 but with a bracket to assist in carrying vertical loading.

Such reinforcement is shown in FIGS. 5 and 6 wherein metal bracket 93 closely engages bolt member 34 at the front end of the bracket. The rear end of the bracket is secured to angle beam 16 by bracket channel 95 and flanged sleeve 94 therein sandwiching the rear of bracket 93 between the angle beam 16 via a washer 96, jam nut 97 threaded on sleeve 94, tandum nut 98 threaded to both sleeve 94 and bolt member 34 and lock nut 99 threaded on bolt member 34.

The pre-fabricated panel may conveniently be formed by laying the slabs with their front surfaces 72 down, drilling the bolt holes and pin holes with assistance of a jig, inserting the bolt members and pins members and then lowering frame 12 down over the bolts member.

As seen in FIGS. 2 to 6, pin member 40 preferably extends horizontally into slab 10.

In accordance with the present invention in a 1¼ inch granite slab bolt holes and pin holes were drilled as shown in FIGS. 2 to 4 to be located ⅞ inch from the rear surface with the pin hole at a 45° angle to the bolt hole. The pin hole was ⅛ inch diameter and the pin a ⅛ inch diameter stainless steel pin 1¼ inches long. The bolt hole was 5/16 inch diameter and the bolt member a 5/16 inch stainless steel bolt. Under stress tests without any epoxy, the slab withstood rearward forces R acting of the bolt member of up to 2200 pounds.

Reference is now made to FIG. 9 showing a horizontal cross-sectional top view through another embodiment of a mounting in accordance with the present invention. Whereas in FIGS. 3 to 6, bolt hole 20 is perpendicular to rear surface 22, in FIG. 9, the axis 60 of the bolt hole forms an acute angle with the rear surface 22. The axis 58 of the pin hole in FIG. 9 also is shown forming an acute angle with rear surface 22. Preferably each of the bolt hole and pin hole form angles of not less than about 30° and, more preferably, not less than about 45°, with the rear surface. Preferably, the axis of the bolt hole and pin hole form, rearward of their intersection an angle B therebetween not less than about 30°, and not greater than about 120°. Preferably angle B may be in the ramge of between about 45° amd 90°.

FIG. 9 shows pin member 40 having external threads 41 complementary to internal threads in aperture 38. FIG. 9 also shows both pin member 40 and bolt member 38 optionally extending rearwardly from the slab to angle beam 16 where both the pin member and bolt member are shown coupled to beam 16 by welds 84. With this configuration the pin member, bolt member and support frame form a truss which will preferably support a slab with out the need for mechanical reinforcing of the bolt against deflection as with the metal bracket shown in FIGS. 5 and 6. In providing a preferred truss the axis 58 and 60 of pin member and bolt member may be lie in the same vertical plane.

In assembly of the configuration of FIG. 9, after screwing the pin member into the bolt member, the pin member may then be secured as by welding to beam 16.

While FIG. 9 shows a truss being formed with bolt member 34 and pin member 40 coupled to beam 16 by welding, either could be secured by other methods such as threading or bolting.

In the illustrated preferred embodiment of FIG. 1, a frame 12 is composed of metal beams. Alternately the frame may comprise a pre-cast concrete panel to which the slabs 10 are coupled via the bolt members and pin members, for example with threaded coupling or with the bolt member and pin member impregnated in or otherwise attached to the pre-cast concrete panel.

The slab of material to be supported to provide the decorative facing may comprise many fragible materials including natural stone, pre-cast concrete, artificial stone, plastic, fiberglass, glass and bonded composites thereof. Preferred natural stones are marble and granite.

Figure 10:
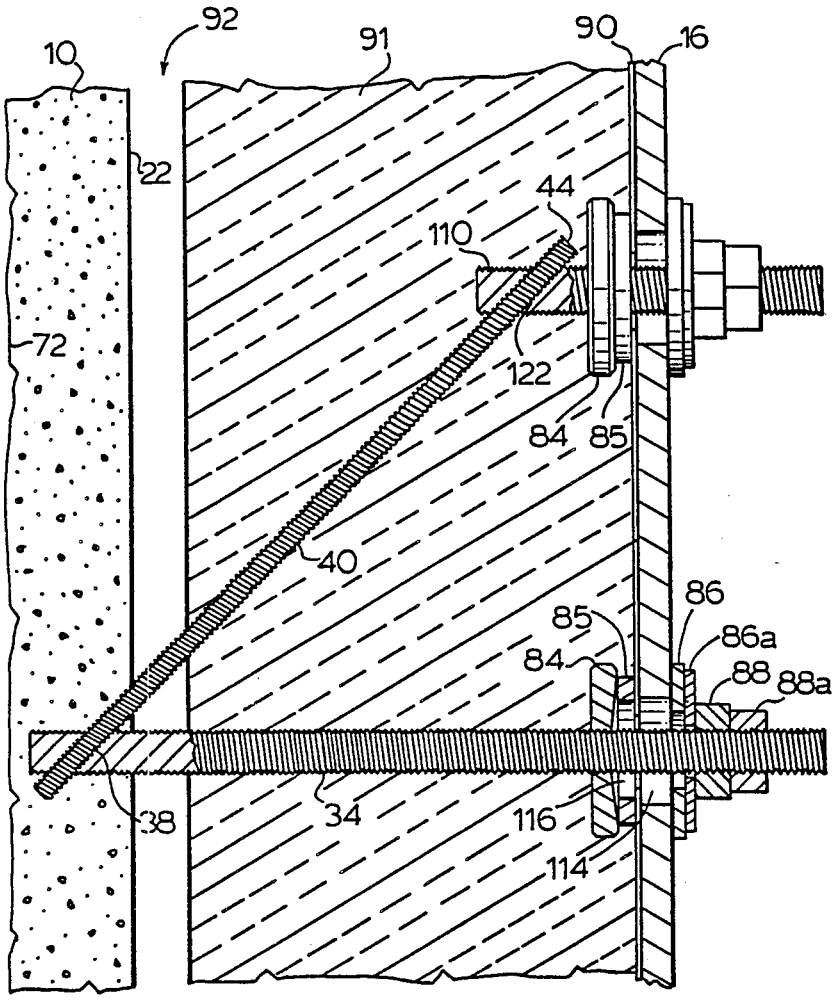
FIG. 10 shows a cross-sectional side view of yet another embodiment of a mounting in accordance with the present invention.
Figure 11:
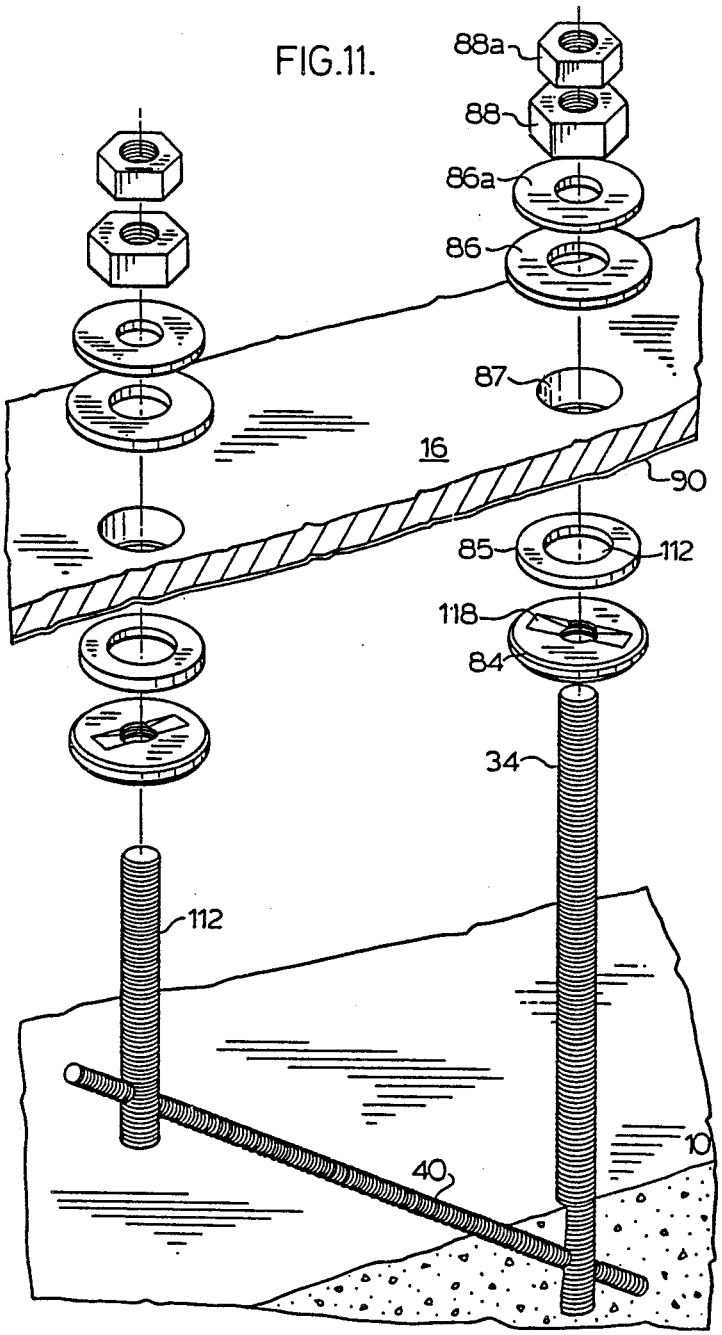
FIG. 11 shows an exploded pictorial view of a number of the components of the embodiment of FIG. 10.

Reference now made to FIGS. 10 and 11 which show a further embodiment of a mounting in accordance with the present invention. As with the other figures showing different embodiments of the invention, similar reference numerals are used to show equivalent elements.

The embodiment of FIGS. 10 and 11 is a modification of the embodiment shown in FIG. 2. In respect of FIG. 10, bolt member 34, bolt hole 20, pin hole 26 and pin member 40 are substantially the same as that shown in FIG. 2 with a notable exception that pin member 40 is threaded and extends rearwardly beyond slab 10. In FIGS. 10 and 11, rear end 44 of pin member 40 extends rearwardly to a second bolt member 110. Second bolt member 110 has a threaded aperture 122. A front portion of pin member 40 is threadably received in aperture 38 in the front portion of first bolt member 34 while a rear portion of the pin member 40 is threadably received within aperture 122 in the front portion of second bolt member 110. Pin member 40 is thus in threaded engagement with both the bolt members.

In FIGS. 10 and 11, both primary bolt member 34 and secondary bolt member 110 are securely coupled to angle beam 16 of frame 12. Beam 16 may be seen to comprise a thin plate-like beam having surfaces normal to the axis of both bolt members. With pin member 40 threaded into each of the two bolt members 34 and 110, a truss is formed which increases the strength of the coupling and assists in carrying the weight of slab 10.

FIGS. 10 and 11 show both primary bolt member 34 and secondary bolt member 110 as having threaded rear portions coupled to angle beam 16 by compression of washers 85, 86 and 86*a* between threaded nuts 84 and 88 onto beam 16. Lock nut 88*a* may also be provided.

Angle beam 16 has apertures 87 through which bolt members 34 and 110 pass. Apertures 87 are sufficiently greater in diameter than the bolt members to permit precise location of the bolt members at desired locations by accomodating movement of the frame, during assembly radially of the bolt members. Washer 85 is also provided with a central aperture 112 substantially greater than the diameter of the bolt members. With the diameters of both aperture 87 and aperture 112 greater than that of the bolt members, torroidal (doughnut shaped) annular spaces 114 and 116 are defined radially between the bolt member and each of beam 16 and washer 85, respectively, as seen in FIG. 10. Nut 84 carries a recessed slot 118 in its axial end surface facing towards angle beam 16. The angular spaces permit access, from the upper rear side of beam 16 as seen in FIG. 11 to slot 118 in nut 84. A screwdriver or other tool may be passed through the annular spaces to engage slot 118 and turn nut 84 to locate nut 84 at a desired location, for example, snug against the forward surface of sheet 90.

In fabrication of a wall panel, slabs 10 may be laid on a flat surface with their front surfaces 72 down. The bolt holes and pin holes may be drilled into the upwardly facing rear surface 22 as with a jig. Bolt member 34 and pin member 40 are then inserted and screwed together with second bolt member 110 either pre-threaded onto pin member 40 or threaded onto pin member 40 after coupling of pin member 40 with bolt member 34. With both bolt member 34 and second bolt member 110 extending rearwardly from the slab and preferably with their threaded rear portions parallel and perpendicular to the rear surface of the slab then nuts 84 and washers 85 are placed on both bolt members. Subsequently a prefabricated frame 12 carrying angle beam 16 with suitably spaced apertures 87 is lowered down over the bolt members with the bolt members to protrude upwardly through the apertures. Frame 12 may be held at a desired height above the slabs and preferably to some extent spaced above nuts 84 and washers 85. Slots 118 of nuts 84 can then be engaged with a suitable tool through apertures 87 and 112 from above frame 12 so as to turn nut 84 to draw nut 84 and washers 85 upwardly into snug engagement against angle beam 16. Thereafter washers 86 and 86*a* and nuts 88 and 88*a* may be applied to lock the bolt members to frame 12. This method of assembly will result in each of slabs 10 being held parallel to frame 12 at desired equal distances in front of the frame. Nuts 84 are not accessible from below frame 12 due to continuous sheet 90. Nuts 84 can after assembly be accessed from the rear of frame 12 by removal of bolts 88, 88*a* and washers 86 and 86*a* if adjustment of location of a slab may be desired.

While a simple slotted screwdriver may be used to access slot 118, a specially adapted tool with a fork-shaped end to engage slot 118 on both sides of the bolt can be easily fashioned.

The embodiment of FIGS. 10 and 11 is preferably disposed with pin member 40 in a vertical plane so as to form a rigid truss which will assist in bearing the weight of slab 10 without bending of the bolt member 34.

Preferably bolt member 34 and bolt member 110 will be parallel and with the axis of pin member 40 intersecting the axis of the bolt members at identical angles. The bolt members are most conveniently perpendicular to angle beam 16 although this is not necessary and washers 85 and 86 could be provided to be wedge shaped and accomodate the intersection of the bolt members with the angle beam at an angle.

Advantageous results have been obtained using a 3/16 inch diameter rod as pin member 40 and a ⅜ inch diameter rod fo the bolt members.

FIGS. 10 and 11 show pin member 40 preferably having a smaller diameter than that of the bolt members. Alternatively, pin member 40 could have a larger diameter than both bolt members with the bolt members to be threaded into apertures provided through pin member 40.

While the invention has been described with reference to preferred embodiments it is not so limited. Many modifactions and variations will now occur to those skilled in the art. For a definition of the invention, reference is made to the attached claims.

What I claim is:

1. A wall assembly wherein a facing slab is mounted to a support structure, said slab having a rear surface, the improvement comprising:

a first bore extending into the slab from the rear surface and ending at a first blind end, a second bore extending into the slab from the rear surface to intersect the first bore, through the first bore, and into the slab beyond the first bore where the second bore ends at a second blind end, first elongate bolt means having a front portion in the first bore and a rear portion which extends rearwardly from the rear surface of the slab, a threaded first aperture through the first bolt means coaxially aligned with the second bore, threaded elongate pin means having a front portion in the second bore and a rear portion which extends rearwardly from the rear surface of the slab, the front portion of the pin means disposed in the second bore in threaded engagement within the first aperture of the first bolt means and passing through the first bore at least partially into that segment of the second bore in the slab beyond the first bore, second elongate bolt means having a front portion and a rear portion with the rear portion carrying first means for coupling to the support structure, the rear portion of one of the pin means and the first bolt means coupled to the front portion of the second bolt means, the rear portion of the other of the pin means and the first bolt means carrying second means for coupling to the support structure, and the first and second bolt means and the pin means forming a rigid truss with the support structure to support and anchor the slab.

2. A wall assembly as claimed in claim 1 wherein the rear portion of the second bolt means being disposed parallel to the rear portion of the other of the pin means and the first bolt means, and the first and second means for coupling to the support structure providing for movement of the second bolt means and the one of the pin means and first bolt means in a direction parallel to that in which the rear portion of the second bolt means is disposed and providing for adjustable locking at different positions.

3. A wall assembly as claimed in claim 2 wherein said one of the pin means and first bolt means comprises the pin means.

4. A wall assembly as claimed in claim 3 wherein said front portion of the second bolt means has a threaded second aperture, the rear end of the pin means is in threaded engagement within the second aperture.

5. A wall assembly as claimed in claim 4 wherein said pin means and the first and second bolt means each comprises an elongate cylindrical rod about a longitudinal axis, with the longitudinal axis of each of the first and second bolt means parallel.

6. A wall assembly as claimed as in claim 5 wherein said rear portion of the first and second bolt means are threaded, said first and second coupling means comprising pairs of threaded nut means threaded onto each of the first and second bolt means.

7. The wall assembly as claimed in claim 6 including plate-like beam means on the support structure with front and rear surfaces normal to the axis of the first and second bolt means and apertures through the beam means through which respective of the first and second bolt means extend for locking thereto by said nut means threaded onto the bolt means on either side of the beam means.

8. The wall assembly as claimed in claim 7 wherein one of the nut means threaded onto the first and second bolt means between the beam means and the slab has a slot in its rearward axial surface facing the beam means, the apertures through the beam means through which the first and second bolt means extend providing an annular space about each of the first and second bolt means of a sufficient size to permit access to the slot from the rearward side of the beam means for adjustment of location of each of the first and second bolt means relative to the beam means from the rearward side of the beam means.

9. An assembly as claimed in claim 1 wherein said slab comprises a slab of marble, granite or pre-cast concrete.

10. An assembly as claimed in claim 8 wherein voids within said first and second bore means are filled with waterproof filler means.

11. A wall assembly as claimed in claim 1 wherein said front portion of the second bolt means has a threaded second aperture, the rear end of the pin means is in threaded engagement within the second aperture.

12. A supporting and anchoring system for a building facing slab comprising a slab having a rear surface, a bolt hole extending into the slab from the rear surface and ending at a first blind end, a pin hole extending into the slab from the rear surface to the bolt hole, through the bolt hole and into the slab beyond the bolt hole where the pin hole ends at a second blind end, a first elongate cylindrical bolt member having a front portion in the bolt hole and a threaded rear portion which extends rearwardly from the rear surface of the slab, a threaded aperture through the first bolt member coaxially aligned with the pin hole, an elongate, threaded cylindrical pin member having a front end in the pin hole and a rear portion which extends rearwardly from the rear surface of the slab, the front portion of the pin means being in threaded engagement within the aperture of the first bolt member and passing through the aperture of the first bolt member into a segment of the pin hole in the slab beyond the first bolt member, a second elongate cylindrical bolt member having a front portion and a threaded rear portion, a threaded aperture through the front portion of the second bolt member, the second portion of the pin member in threaded engagement within the aperture through the second bolt member, first coupling means to couple the rear portion of the first bolt member to a support structure and second coupling means to couple the rear portion of the second bolt member to the support structure wherein by coupling said first and second bolt members to the support structure, the first and second bolt members and the pin members form a rigid truss.

13. A system as claimed in claim 12 wherein the axis of these first and second bolt members are parallel and the axis of the pin member intersects with the axes of the first and second bolt members.

14. A system as claimed in claim 13 wherein the axis of the pin member forms an angle of between about 30° to 60° with the axis of each of the first and second bolt members.

15. A system as claimed in claim 14 wherein the first and second bolt members are substantially perpendicular to the rear surface of the slab.

16. A system as claimed in claim 15 wherein the axis of the pin member forms an angle of about 45° with the axis of the first and second bolt members.

17. A system as claimed in claim 13 further comprising thin plate-like beam means fixably attached to the support structure, apertures through the beam means with first and second bolt members extending through the apertures through the beam means, the first and second coupling means comprising, on each of the first and second bolt members, threaded nut members which compress the beam means therebetween, the first and second bolt members being disposed normal to surfaces of the beam means.

18. A system as claimed in claim 12 wherein said slab comprises a slab of marble, granite or pre-cast concrete.

* * * * *